US009700148B2

(12) United States Patent
Nguyen et al.

(10) Patent No.: US 9,700,148 B2
(45) Date of Patent: Jul. 11, 2017

(54) SEATING SYSTEM WITH MULTI-POSITION BACKREST

(71) Applicant: Steelcase Inc., Grand Rapids, MI (US)

(72) Inventors: Huu-Toan Antoine Nguyen, Milan (IT); Jesse Menayan, Sausalito, CA (US); Michael Waalkes, Aspen, CO (US); Robert Arko, San Francisco, CA (US); Timothy Stuive, Jenison, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 14/991,312

(22) Filed: Jan. 8, 2016

(65) Prior Publication Data

US 2016/0166071 A1 Jun. 16, 2016

Related U.S. Application Data

(63) Continuation of application No. 14/223,415, filed on Mar. 24, 2014, now Pat. No. 9,259,089, which is a continuation of application No. 13/486,406, filed on Jun. 1, 2012, now Pat. No. 8,721,000.

(51) Int. Cl.

| | |
|---|---|
| ***A47C 1/00*** | (2006.01) |
| ***A47B 83/02*** | (2006.01) |
| ***A47C 15/00*** | (2006.01) |
| ***A47C 1/024*** | (2006.01) |
| ***A47C 7/02*** | (2006.01) |
| ***A47C 7/40*** | (2006.01) |

(Continued)

(52) U.S. Cl.

CPC ..... *A47C 13/00* (2013.01); *A47C 1/024* (2013.01); *A47C 1/0244* (2013.01); *A47C 7/02* (2013.01); *A47C 7/40* (2013.01); *A47C 7/402* (2013.01); *A47C 17/04* (2013.01)

(58) Field of Classification Search

CPC ..... A47C 1/024; A47C 1/0244; A47C 7/02; A47C 7/40; A47C 7/402; A47C 13/00; A47C 17/04

USPC ..... 297/378.1, 158.1, 174 R, 245

See application file for complete search history.

(56) References Cited

U.S. PATENT DOCUMENTS

| | | | |
|---|---|---|---|
| 124,765 | A | 3/1872 | Schafer |
| RE8,131 | E | 3/1878 | Ross |
| 320,676 | A | 6/1885 | Ott |

(Continued)

FOREIGN PATENT DOCUMENTS

| | | | |
|---|---|---|---|
| DE | 3742465 | C2 | 5/1991 |
| EP | 1464256 | B1 | 6/2010 |
| GB | 2082903 | A | 3/1982 |

*Primary Examiner* — Rodney B White

(57) ABSTRACT

An article of furniture comprises a base providing a seating area and having a back edge and a front edge, a support coupled to the base near the back edge and a distance from the front edge, and a linkage coupling the support to the base so that the support can be presented in generally upright and generally forward positions relative to the base. The distance from the front edge of the base to the support in the upright position is greater than the distance from the front edge of the base to the support in the forward position, and the support provides a surface that is a top surface when the support is in the upright position and is a rear surface when the support is in the forward position. The support remains between the back and front edges of the base in both the upright and forward positions.

22 Claims, 5 Drawing Sheets

(51) Int. Cl.
*A47C 17/04* (2006.01)
*A47C 13/00* (2006.01)

(56) References Cited

U.S. PATENT DOCUMENTS 582,847 A 5/1897 Coates
1,083,797 A 1/1914 Brown
1,312,110 A 12/1918 Duncan et al.
1,374,661 A 4/1921 Hubbert
1,776,464 A 9/1930 Blackman
1,874,782 A 8/1932 McMurtrey
D169,911 S 6/1953 Netzer
2,645,788 A 7/1953 Knoll et al.
D170,190 S 8/1953 Glass
2,697,479 A 12/1954 Fesler
2,705,994 A * 4/1955 Stattler ..... A47C 4/04 297/378.1 X
2,710,412 A 6/1955 Bayer
2,723,401 A 11/1955 Horst
2,796,919 A 6/1957 Ginsberg
D181,845 S 1/1958 Frey et al.
D186,308 S 10/1959 Knoll
2,969,107 A 1/1961 Ira et al.
2,985,892 A 5/1961 Garrigus et al.
D190,805 S 7/1961 Deskey
3,003,815 A 10/1961 Zinn
3,171,139 A 3/1965 Ziegenfuss
3,256,533 A 6/1966 Cornelius
3,288,527 A 11/1966 Martens
3,319,269 A 5/1967 Maddox
3,422,467 A 1/1969 Wilberg
3,483,573 A 12/1969 Lucero
3,580,630 A * 5/1971 Fetter ..... B60N 2/3011 297/378.1 X
D220,997 S 6/1971 Svezia et al.
3,635,521 A * 1/1972 Shivvers ..... A47B 85/04 297/378.1 X
3,738,699 A * 6/1973 Fain ..... B60P 3/32 296/168
3,811,728 A 5/1974 Redemske
D241,485 S 9/1976 Blodee
4,004,836 A 1/1977 Kristensson
D247,595 S 3/1978 Corson et al.
4,110,855 A 9/1978 Acker
4,188,066 A 2/1980 Terenzoni
4,205,405 A 6/1980 Hagney
D269,057 S 5/1983 Schatz et al.
4,420,186 A 12/1983 Vogt
D272,968 S 3/1984 Fairaizen
D273,254 S 4/1984 Fairaizen
4,447,920 A 5/1984 Rosen
D279,237 S 6/1985 Balonick
D283,562 S 4/1986 Raftery
D284,142 S 6/1986 Raftery
4,619,005 A * 10/1986 Rutens ..... A47C 17/04 297/174 R
4,625,347 A 12/1986 McElmurry et al.
D290,559 S 6/1987 Raftery
D291,949 S 9/1987 Hendrick
4,754,507 A 7/1988 Edge
5,067,187 A 11/1991 Messina
5,067,771 A * 11/1991 Ellis ..... A47C 1/16 297/378.1 X
D335,035 S 4/1993 Floyd
5,344,216 A 9/1994 Suominen
D360,310 S 7/1995 Stamberg et al.
5,432,967 A 7/1995 Raftery
5,522,097 A * 6/1996 Ciccotelli ..... A47C 17/04 5/2.1
5,787,522 A 8/1998 Swihart
5,803,198 A 9/1998 Baxter et al.
6,151,765 A 11/2000 Asplund
6,182,952 B1 2/2001 Gutierrez
6,213,546 B1 4/2001 Malusev et al.
6,247,753 B1 6/2001 Alvestad
D448,580 S 10/2001 Carlson
D448,946 S 10/2001 Goetz
6,347,418 B1 2/2002 Leib
D455,574 S 4/2002 Rosson et al.
D457,737 S 5/2002 Citterio
6,447,067 B1 9/2002 Williams et al.
D466,312 S 12/2002 Hutton
D473,062 S 4/2003 Natuzzi et al.
D473,723 S 4/2003 Pesso
D476,819 S 7/2003 Williams et al.
6,616,234 B1 9/2003 King
D480,883 S 10/2003 Williams et al.
D482,535 S 11/2003 Williams et al.
D482,536 S 11/2003 Williams et al.
D486,652 S 2/2004 Nemeth
D487,998 S 4/2004 Natuzzi et al.
D498,064 S 11/2004 Gomez
6,880,482 B2 4/2005 Huse
6,969,117 B2 11/2005 King et al.
D513,564 S 1/2006 Nobles et al.
6,981,741 B2 1/2006 Sirjoo
D520,263 S 5/2006 Nobles et al.
D525,460 S 7/2006 Nobles et al.
D525,802 S 8/2006 Spear
D526,803 S 8/2006 Lee
D530,105 S 10/2006 Pesso
D533,365 S 12/2006 Martin
D538,549 S 3/2007 Spear
D539,561 S 4/2007 Martin
D544,237 S 6/2007 Nemschoff
D545,070 S 6/2007 Hutton
D553,867 S 10/2007 Williams et al.
D558,993 S 1/2008 Saint et al.
D559,003 S 1/2008 Lissoni
D560,919 S 2/2008 Simons, Jr.
D565,857 S 4/2008 Nemschoff
D566,416 S 4/2008 Mourgue
D566,980 S 4/2008 Mourgue
D567,526 S 4/2008 Williams et al.
7,364,238 B2 4/2008 Higgs et al.
D569,112 S 5/2008 Swanson
D577,211 S 9/2008 Natuzzi
D586,131 S 2/2009 Cramer et al.
D586,156 S 2/2009 Schweikarth et al.
D587,918 S 3/2009 Bergman et al.
7,540,042 B2 6/2009 Chen
D600,466 S 9/2009 Cramer et al.
7,648,197 B1 1/2010 Delmestri
7,708,346 B2 5/2010 White et al.
D624,328 S 9/2010 Grandin et al.
D628,403 S 12/2010 Starck
D639,083 S 6/2011 Martin
D644,048 S 8/2011 Blomstrom
D651,416 S 1/2012 Martin et al.
8,721,000 B2 * 5/2014 Nguyen ..... A47C 7/402 297/378.1 X
9,259,089 B2 * 2/2016 Nguyen ..... A47C 1/0244
2005/0140184 A1 6/2005 Williams et al.

* cited by examiner

SEATING SYSTEM WITH MULTI-POSITION BACKREST

RELATED APPLICATIONS

This application is a continuation of U.S. patent application Ser. No. 14/223,415, filed on Mar. 24, 2014, now U.S. Pat. No. 9,259,089 which is a continuation of U.S. patent application Ser. No. 13/486,406, filed on Jun. 1, 2012, now U.S. Pat. No. 8,721,000.

FIELD

The present invention relates to an article of furniture comprising a seating system with a back support or backrest that can be configured in multiple positions.

BACKGROUND

Articles of furniture are used in a work environment, for example, seating systems, including chairs and couches/sofas, that provide seating surfaces for persons in the work environment. Other associated articles of furniture such as tables to provide individual and shared work surfaces and panel walls (e.g. to provide visual or auditory privacy) are also used in a work environment.

In a work environment, persons may engage in a wide variety of tasks and types of activities, including focused individual work, collaborative interactions, one-on-one and group meetings, sharing of materials and documents, planned or informal social interactions, as well as intermittent relaxation and refreshment. Areas for focused work (e.g. office or task areas) and areas for social interaction (meeting or lounge areas) may be provided in a work environment. Ideally, the work environment provides articles of furniture that are configured or that can be arranged to support the wide variety of tasks and activities that persons engage in during the work day in the work environment.

Articles of furniture are used both for work or task-intensive areas and for social or lounge areas in a work environment. The work or task-intensive areas may provide conventional "office" furniture, such as desks and tables, office chairs and task seating, as well as related articles of furniture and other equipment configured for the office setting. Such "office" furniture is generally configured to support office tasks, including individual work and typically more structured collaborative work. The lounge areas may provide articles of furniture intended to be more conducive to relaxation and social interaction, such as lounge chairs and couches/sofas as well as tables having an appearance that is more "residential." Articles of furniture for a lounge area in a work environment are typically configured for informal and collaborative/social interaction.

At times, persons in each type of area (office/task area or social/lounge area) in a work environment may engage in substantially similar individual or collaborative activities, for example, use of technology/computers, review of documents and materials on worksurfaces, communications of information to one or more other persons, etc.

Persons in a lounge area may wish to engage in task-related work. Because the typical articles of furniture in a lounge area are not ideally suited for certain of the tasks or activities intended to be performed, the persons engaged in the tasks or activities may choose to return to an office/work area for the task (which may result in a loss of time, attention or productivity) or may remain in a lounge area and attempt to continue work on the task notwithstanding difficulties arising because the articles of furniture are not ideally suited for the task (which may result in a loss of comfort, attention or productivity). For example, if a person engaged in a task suited for work at a table or worksurface is in lounge seating in a lounge area, the person may not have the comfort of a back support or backrest (as would be provided if the person was in a suitable office chair or task seating in an office area). In certain meetings or other interactions that may occur in a lounge area in a work environment, a relaxed or reclined seated posture as typically invited by the configuration of the backrest of typical lounge seating may not be comfortable for some or all of the involved persons or may not be optimum or completely appropriate in the context of the interaction.

Articles of furniture for a lounge area in a work environment are typically configured with a backrest positioned to provide comfort for a person engaged in lounge activities (rather than task or office activities). Such articles of furniture may not also be configured to provide comfort for persons who wish to engage in "office" or task activities (i.e. tasks of the type typically performed in an office area).

SUMMARY

An article of furniture for use in a work environment can readily and conveniently be configured for comfortable use by a person when engaged in multiple different types of activities. An article of furniture can be provided in a lounge area of a work environment and can conveniently be configured and reconfigured by persons as needed for comfortable use in a variety of tasks and activities, for example, both during office/task-related activity or during social/lounge-related activity.

An article of furniture comprises a base providing a seating area and a support coupled to the base and having a width relative to the seating area of the base. A linkage couples the support to the base so that the support can be presented in a generally upright position and in a generally forward position relative to the base. The width of the support in the forward position is greater than the width of the support in the upright position.

The present invention also relates to a seating system comprising a base comprising a seat and a backrest comprising a first surface and a second surface. A member couples the backrest for movement on a path of travel relative to the base. The backrest is moveable to an upright position and to a forward position. When the backrest is in the first position the first surface is presented in a generally downward orientation and the second surface is presented in a generally rearward orientation relative to the base. When the backrest is in the second position the first surface is presented in a generally forward orientation and the second surface is presented in a generally downward orientation relative to the base.

A seating system comprises a base comprising a top surface configured to provide a seat and a backrest coupled to the base comprising a first surface and a second surface. The backrest is configured for movement to a first position and to a second position relative to the base. When the backrest is in the first position the first surface is presented in a generally downward orientation and the second surface is presented in a generally rearward orientation relative to the base. When the backrest is in the second position the first surface is presented in a generally forward orientation and the second surface is presented in a generally downward orientation relative to the base.

FIGURES

DESCRIPTION

Referring to FIGS. 1A-1E, articles of furniture comprising a seating system are shown according to an exemplary embodiment. As shown, the articles of furniture comprising the seating system provide a person or persons with a seating surface or seat and a back support or backrest. According to an exemplary embodiment (as shown in FIGS. 1A-1E), the articles of furniture are configured for use in a work environment, including an office area or lounge area/setting. According to any preferred embodiment, the articles of furniture comprising the seating system will be configurable to support a person or persons engaged in multiple functions, such as various work-related tasks or lounge-social interactions in the environment.

Figure 1A:
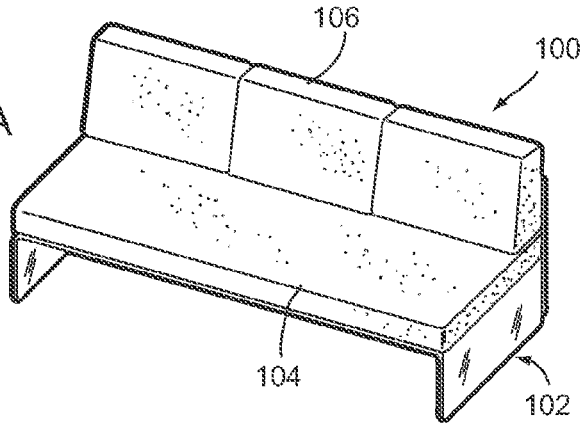
FIGS. 1A through 1E are perspective views of a seating system comprising articles of furniture for use in a work environment according to an exemplary embodiment.
Figure 1B:
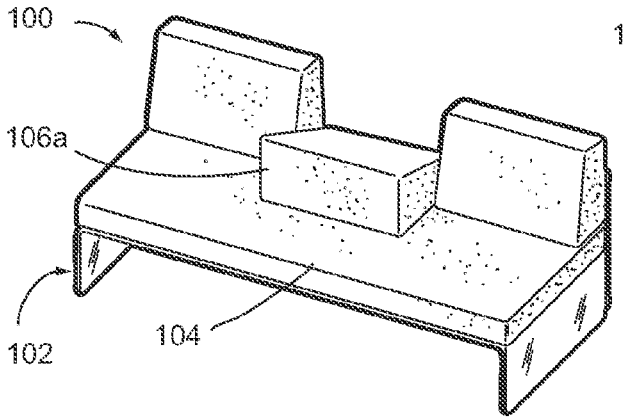
Figure 1C:
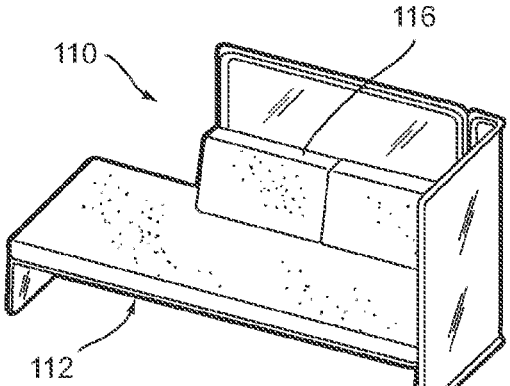
Figure 1D:
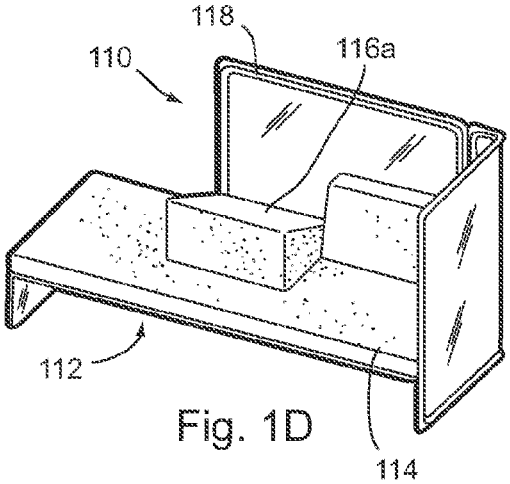
Figure 1E:
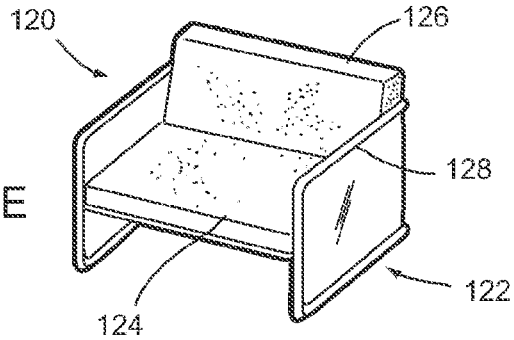

FIGS. 1A and 1B show a lounge seating arrangement in the form of couch or sofa 100 having a base 102 with a seating surface 104 and three backrests 106. FIGS. 1C and 1D show a lounge seating arrangement in the form of a couch or sofa 110 having a base 112 and a seating surface 114 and two backrests 116; the arrangement is provided in association with panel walls 118 (i.e. to provide for visual and auditory privacy). FIG. 1E shows a seating arrangement in the form of a chair 120 having a base 122 with a seating surface 124 and one backrest 126 and two arms 128.

The seating surfaces are configured in a form to provide a support surface for a person (or persons) using the arrangement, comprising a seating surface and a back support or backrest; the backrests are also configured to present an area shown as surfaces intended to support a person (or persons) using the arrangement. The arrangement may be provided in a wide variety of other forms, with varying configurations of seating surfaces, varying numbers of backrests, fewer or more/other associated articles of furniture, such as modular components, benches (including seating surfaces without a backrest or with a partial backrest), tables and desking solutions, worksurfaces, panel walls, combinations/multi-function articles, connectivity and computing support equipment, etc.

As shown in FIGS. 1A-1B and 1C-1D, articles of furniture comprising a seating system can be provided with a backrest configured to have two stable positions: an upright position (as shown in FIGS. 1A and 1C) and a forward position as shown for backrest 106*a* (in FIG. 1B) and for backrest 116*a* (in FIG. 1D). As shown in FIGS. 1A-1B and 1C-1D, at least one of the backrests of the lounge seating can be repositioned from the upright position to the forward position (FIGS. 1B and 1D). As shown in FIGS. 1A-1E, the backrest when in the upright position provides a back support area in a generally conventional relationship relative to the seating surface (e.g. generally suitable for a person or persons engaged in "lounge" activities for a lounge seating arrangement); the backrest when repositioned to the forward position extends further onto and provides a back support area further onto the seating surface (e.g. in a manner intended to be more suitable for a person or persons engaged in "task" activities). According to any preferred embodiment, the seating system will be configured to provide a backrest giving suitable and stable postural support for seated persons when in either the upright position or the forward position.

Figure 2:
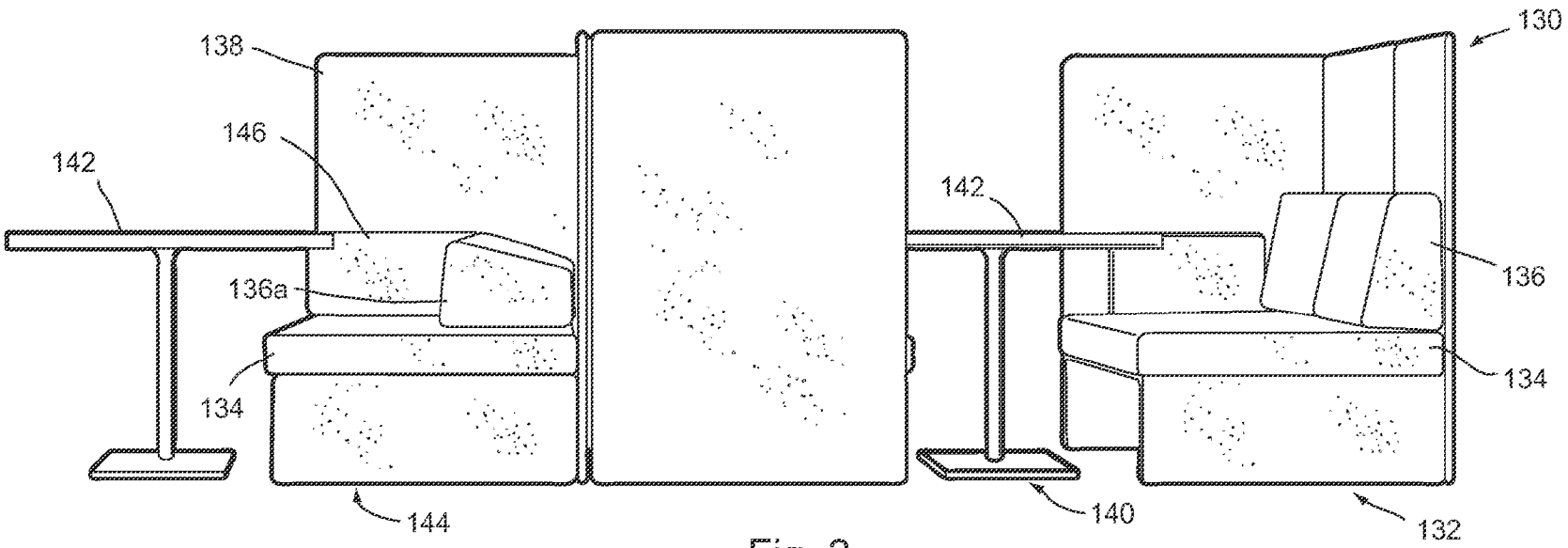
FIG. 2 is a side elevation view of a seating system and other associated articles of furniture in a work environment according to an exemplary embodiment.

Referring to FIG. 2, a lounge seating arrangement is shown in the form of a sofa 130 having a base 132 with a seating surface 134 and backrests 136 and 136*a*; the arrangement is provided in association with panel walls 138 and worksurfaces 142 shown as provided by tables 140. Lounge seating arrangement 130 is provided in an upholstered form as providing fabric covering 144 for cushions provided at the seating surfaces and as part of the backrests (and with matching fabric covering for other exposed surfaces of the related articles of furniture of the collection such as for panel walls 138 and armrests 146); as indicated, backrests with cushions have a padded and rounded form intended to provide a particular aesthetic appearance and/or enhanced user comfort.

As shown in FIG. 2, when the backrest of the arrangement is in the upright position more of the seating surface is available for use and support of a person (or persons) using the arrangement; for example, a user seated in the seating surface can lean back onto the backrest in a more relaxed position (i.e. a reclined or "lounge" position). As also shown in FIG. 2, when the backrest of the arrangement is in the forward position less of the seating surface is available for use and support of a person (or persons) using the arrangement; for example, a user seated on the seating surface can lean back onto the backrest in a more upright position (i.e. a more conventional seated or "task" position). According to an exemplary embodiment, repositioning of the backrest from the upright position to the forward position is conducive to use of the seating arrangement in a different manner, for example, in a manner where an area of the backrest provides back support for a user seated on the seating surface and working at an associated worksurface (as shown in FIG. 2).

Figure 3C:
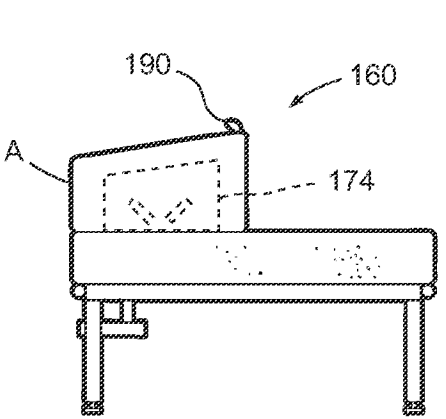
FIGS. 3A through 3C are schematic diagrams of a seating system showing the repositioning of a back support or backrest according to an exemplary embodiment.
Figure 3B:
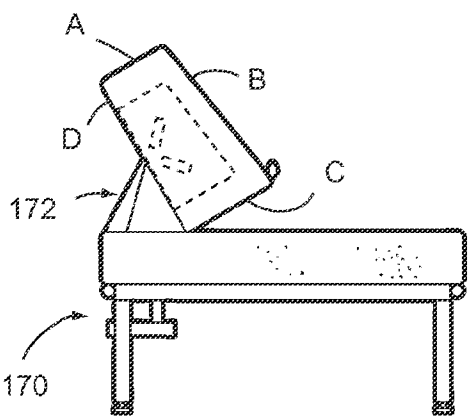
Figure 3A:
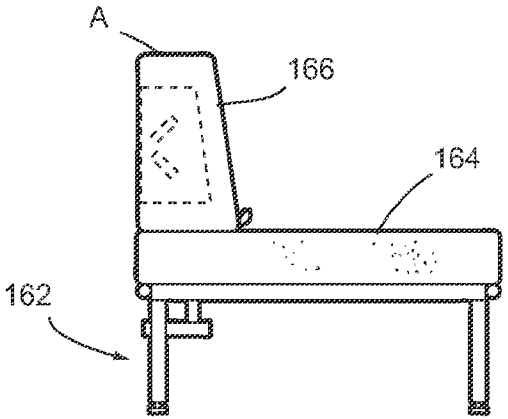

FIGS. 3A through 3C show a schematic diagram of a lounge seating arrangement 160 according to an exemplary embodiment. Base 162 provides a seating surface 164. A backrest 166 is coupled to base 162 by a mounting structure 170 (shown partially/schematically) and a hinge assembly 172 (shown partially/schematically). Referring to FIGS. 3A through 3C, repositioning of the backrest from an upright position (shown in FIG. 3A) and through an intermediate or transition position (shown in FIG. 3B) to a forward position (shown in FIG. 3C) is shown. Backrest 166 is provided with a handle shown as a strap 190 for use by a person repositioning the backrest from the upright position to the forward position. Pulling the strap will facilitate the initial movement or dislodging of the backrest from the upright position and lifting of the backrest into the forward position.

Figure 9A:
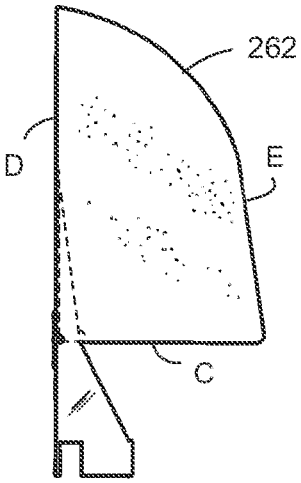
FIGS. 9A and 9B are side elevation views of a backrest according to an exemplary embodiment.
Figure 9B:
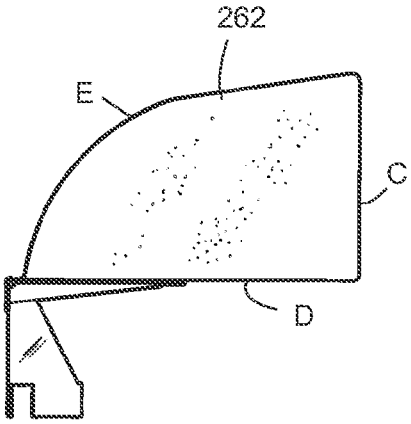

According to the exemplary embodiment (shown schematically in FIGS. 3A-3C), when in the upright position the backrest provides a top surface A, a front surface B (presenting an area for supporting the back of a person using the seating surface), a bottom surface C (providing an area in interface with the seating surface), and a rear surface D (a rearward facing surface), as shown in FIG. 3A. When repositioned to the forward position, the backrest again provides a top surface B, a front surface C (presenting an area for supporting the back of a person using the seating surface), a bottom surface D (providing an area in interface with the seating surface), and a rear surface A, as shown in FIG. 3C. As shown schematically in comparison of FIGS. 3A and 3C, surface A provides the top surface when the backrest is in the upright position and the rear surface when the backrest is in the forward position; surface B provides the front surface when the backrest is in the upright position and the top surface when the backrest is in the forward position; surface C provides the bottom surface when the backrest is in the upright position and the front surface when the backrest is in the forward position; surface D provides the rear surface when the backrest is in the upright position and the bottom surface when the backrest is in the forward position. As shown in FIGS. 9A and 9B, according to an exemplary embodiment, a backrest 262 may be provided in a form that presents three surfaces (rather than four surfaces). According to other exemplary and alternative embodiments, the support or backrest may be presented in a wide variety of other forms and shapes, with a lesser or greater number of surfaces, with surfaces that are not "flat" or discrete in form, with bearing or support areas having various shapes and forms, with areas and surfaces in various combinations of shapes or forms, with surfaces/areas in curved or flat or other various or composite forms, etc.

Figure 4A:
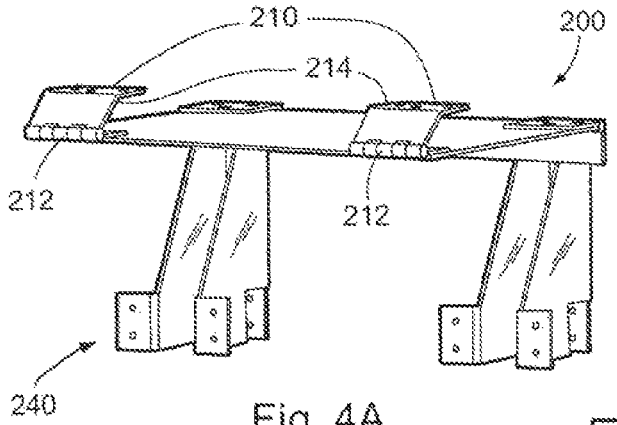
FIGS. 4A and 4B are perspective views showing a hinge assembly and mounting structure for a backrest according to an exemplary embodiment.
Figure 4B:
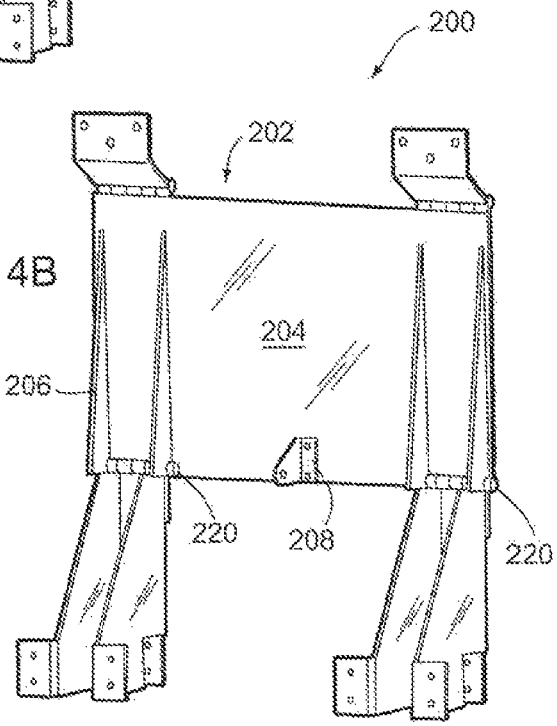

Referring to FIGS. 4A-4B and 5A-5B, a hinge assembly 200 and a mounting structure 240 to couple the backrest to the base are shown according to an exemplary embodiment. FIG. 4A shows hinge assembly 200 in the forward position; FIG. 4B shows hinge assembly 200 in the upright position.

As shown in FIGS. 4A-4B and 5A-5B, hinge assembly 200 comprises a member shown as a base plate 202 with a first hinge set 210 and a second hinge set 220. Base plate 202 comprises a generally flat sheet structure 204 with two sets of reinforcing gussets 206 and a mounting bracket 208 (attached by fasteners such as screws). First hinge set 210 comprises a pair of hinges 212 including mounting brackets 214 (shown as comprising plates) with apertures for fasteners (such as screws). Second hinge set 220 comprises a pair of hinges 222 including mounting brackets 224 (shown as comprising plates) with apertures for fasteners (such as screws). First hinge set 210 is configured for mounting to a frame 230 (shown as a box frame) within a corresponding backrest 260 (shown in FIG. 5B).

As shown in FIGS. 4A-4B and 5A-5B, mounting structure 240 comprises a pair of posts shown as brackets 242 having a generally channel-shaped cross-section and generally triangular profile. Posts are provided with mounting tabs 244 (with apertures for fasteners such as screws) at the base that allow attachment to a corresponding article of furniture (such as the base of the lounge seating arrangement shown in FIGS. 1A-1E, 2 and 3A-3C); posts are provided with a mounting area 248 (with apertures for fasteners such as screws) at the top that allow attachment to second hinge set 220 of hinge assembly 200 and by base plate 202 and first hinge set 210 to frame 230 of backrest 260.

According to any preferred embodiment, the hinge assembly and mounting structure is configured to securely attach the back support or backrest to the base of the lounge seating arrangement, in the manner shown in FIGS. 1A-1E, 2 and 3A-3C (i.e. allowing movement of the backrest between a secure/stable upright position to a secure/stable forward position). As indicated and shown in FIGS. 3A-3C, the posts of mounting structure 172 are in a generally vertical orientation when mounted to base 162 of the seating system. See also FIG. 7.

Figure 6A:
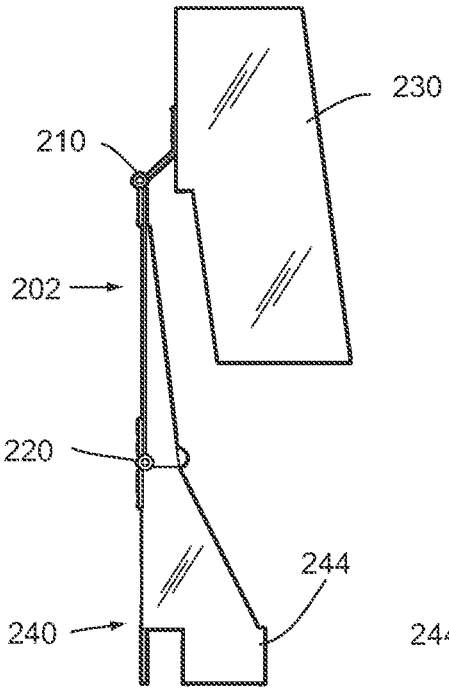
FIGS. 6A and 6B are side elevation views showing a hinge assembly with frame and a mounting structure for a backrest according to an exemplary embodiment.
Figure 6B:
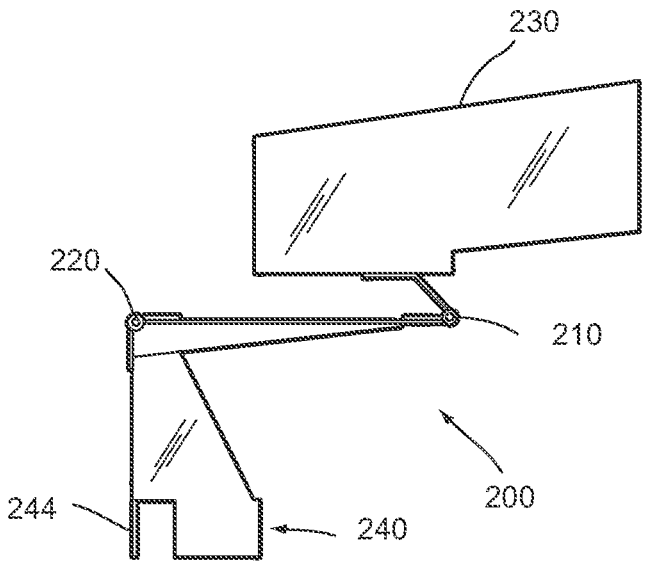

FIGS. 6A and 6B show the articulation of the hinge assembly to reposition the frame of the backrest relative to the mounting structure as to facilitate movement of the backrest from the upright position (FIG. 6A) to the forward position (FIG. 6B) relative to the base of a corresponding article of furniture (as shown in FIGS. 1A-1E, 2 and 3A-3C). As shown in FIGS. 6A and 6B, first hinge set 210 rotates approximately 90 degrees (shown as in a rearward or counterclockwise orientation) to reposition frame 230 of the backrest relative to hinge assembly 200; second hinge set 220 rotates approximately 90 degrees (shown as in a forward or clockwise orientation) to reposition hinge assembly 200 relative to mounting structure 240. As indicated in FIGS. 3A-3C and 6A-6B, the hinge assembly has a defined path or range of movement as the backrest is repositioned generally constrained by the interaction between the backrest and the seating surface of the article of furniture. The range of movement of the backrest relative to the base may also be limited by the configuration of the hinge assembly and mounting structure (e.g. by a mechanical obstruction of the base plate relative to the posts or by an additional mechanism or structure such as a cable or wire as shown in FIG. 7).

Figure 5A:
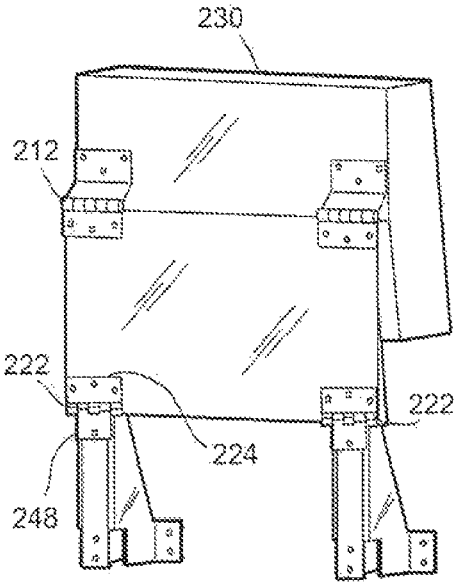
FIGS. 5A and 5B are perspective views showing a hinge assembly with frame and mounting structure for a backrest according to an exemplary embodiment.
Figure 5B:
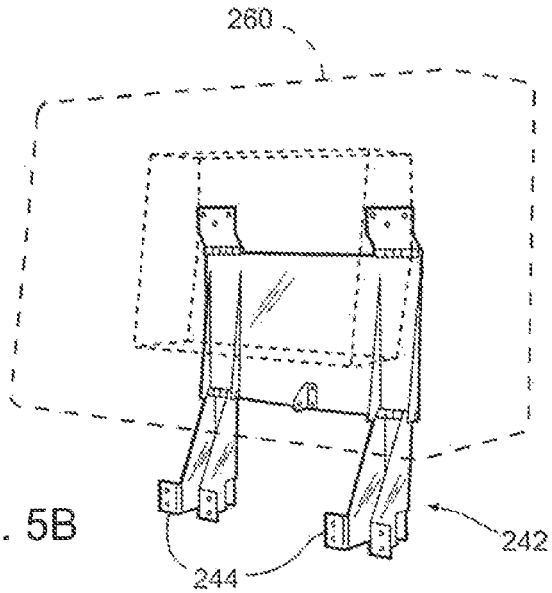

Referring to FIGS. 6A and 6B, frame 230 has a box-shaped form (with a mounting area for attachment to the first hinge set); according to a particularly preferred embodiment the form of the frame will correspond generally to the form of the corresponding back support or backrest (e.g. backrest 260 as shown in FIG. 5B) or can otherwise be configured to fit and engage securely to the structure or member functioning as the back support or backrest (i.e. by any suitable arrangement or method). According to any preferred embodiment, the frame is configured for secure installation within the backrest by a suitable mounting arrangement (i.e. by attachment to the interior structure of the backrest, see, e.g., FIG. 7). As indicated in FIGS. 1A-1E, 2 and 5B, the back support or backrest may have a cushion or padding that fits around the frame as well as an upholstered cover (e.g. fabric or other material) that corresponds in an aesthetic fashion to the cover of the base (as well as to other associated articles of furniture) or that otherwise is selected to provide a desired appearance. According to an alternative embodiment, the backrest may comprise a cushion with a structure that can be installed over (and around) the frame. According to other alternative embodiments, the frame of the backrest may be provided in any of a wide variety of configurations (including a configuration where the structure of the backrest provides a suitable frame) for coupling to the hinge assembly.

Figure 7:
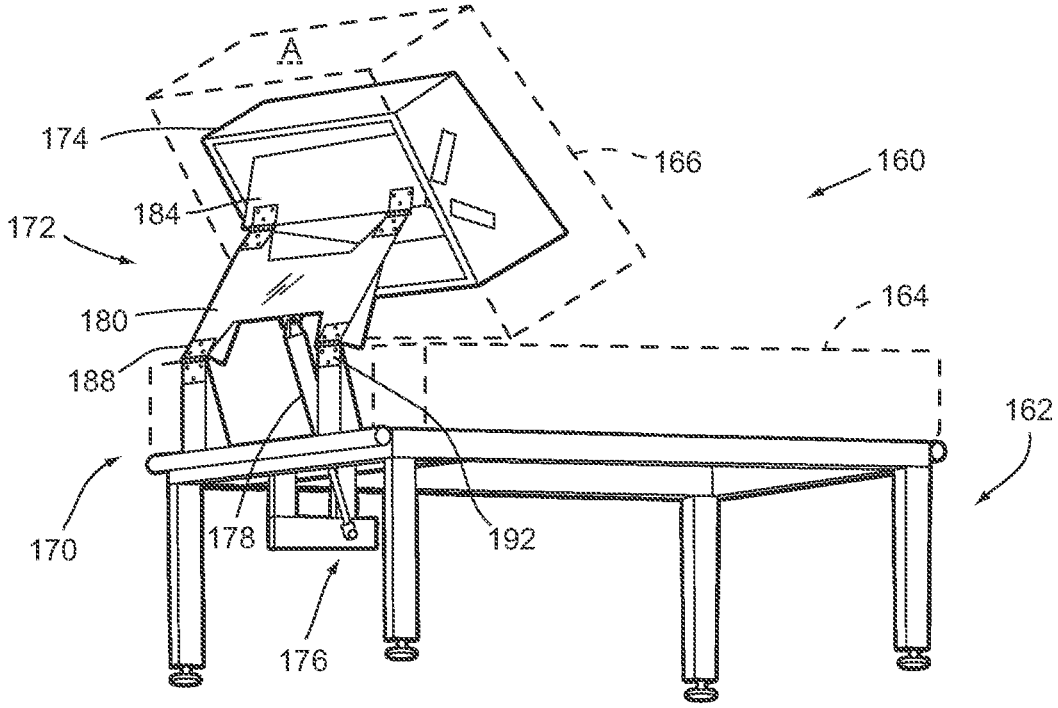
FIG. 7 is a perspective view showing a seating system with a hinge assembly and mounting structure for a backrest according to an alternative embodiment.

Referring to FIG. 7, hinge assembly 172 and mounting structure 170 are shown as coupling backrest 166 to a base 162 of an article of furniture shown as a seat 160 according to an alternative embodiment. As shown in FIG. 7, base 160 provides a supplemental mounting structure 176 for connection of an actuator or assist device shown as a pneumatic cylinder 178 intended to facilitate movement of the backrest between the forward position and the upright position (e.g. providing a biasing force helping to lift the backrest into the upright position). As shown, actuator 178 is pivotally connected at one end to a mounting bracket on base plate 180 of the hinge assembly 172 and pivotally connected at the other end to supplemental mounting structure 176. Base plate 180 has an H-shaped form; a first hinge set 184 is coupled to a flange or tab on frame 174 installed within backrest 166; a second hinge set 188 is coupled to base plate 180 and to mounting structure 170. Cables 192 connected between mounting structure 170 and frame 174 provide a limit on the range of movement of hinge assembly 172.

As shown in FIGS. 3A-3C and 7, support or backrest 166 does not simply fold down and forward when moved from the upright position to the forward position; backrest 166 is tilted and "flipped" (i.e. folded rearward/backward) so that when in the upright position, surface A is the top surface and in the forward position surface A is the rear surface.

Figure 8A:
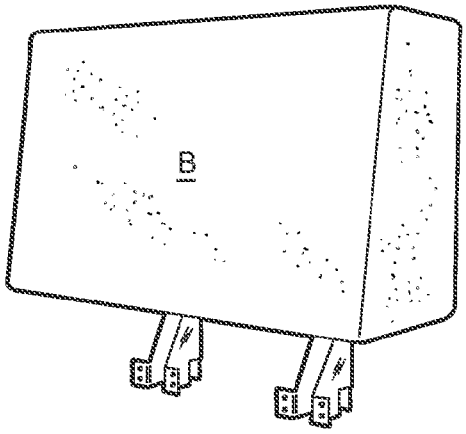
FIGS. 8A and 8B are perspective views of a backrest according to an exemplary embodiment.
Figure 8B:
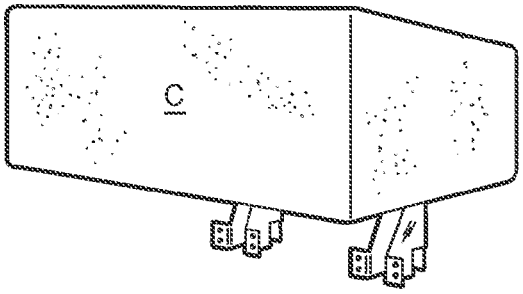

Referring to FIGS. 8A and 8B, a backrest 260 is shown according to an exemplary embodiment. In FIG. 8A, backrest 260 is in an upright position with a surface area B presented for support of the back of a user. In FIG. 8B, backrest 260 is in a forward position with a surface area C presented for support of the back of a user. As indicated in FIGS. 8A-8B, a different surface or area for support of the back of a user is presented in the upright position than in the forward position.

Referring to FIGS. 9A and 9B, a backrest 262 having a curved surface E is shown according to an exemplary embodiment; backrest 262 presents in effect three surfaces. The surfaces presented by backrest 262 when in the upright position (FIG. 9A) are forward surface E (e.g. to provide a back support area for a seated person), bottom surface C and rear surface D. The surfaces presented by backrest 262 when in the forward position (FIG. 9B) are forward surface C (e.g. to provide a back support area for a seated person), bottom surface D and top surface E. According to other exemplary and alternative embodiments, the backrest may have any of a variety of different forms that present a corresponding variety support areas and/or surfaces (or combinations of areas and surfaces); the backrest may have a substantially rounded form (see, e.g., FIG. 9A-9B) or may have generally flat surfaces (see, e.g. FIG. 8A-8B and 10A-10B) or may have a combination of generally rounded surfaces (and edges) and generally flat surfaces (see, e.g. FIG. 2).

Figure 10A:
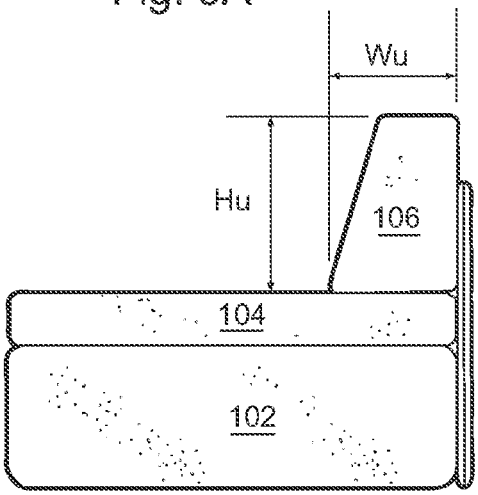
FIGS. 10A and 10B are schematic diagrams of a seating system showing the repositioning of a backrest according to an exemplary embodiment.
Figure 10B:
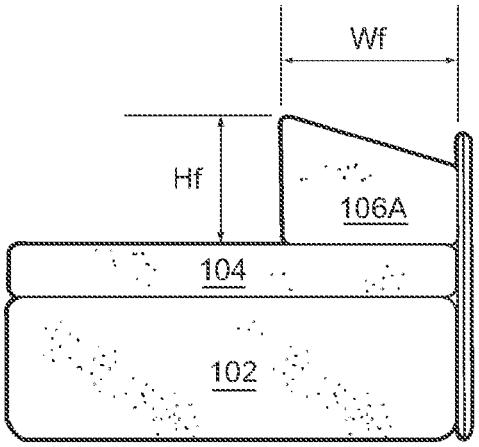

Referring to FIGS. 10A and 10B, a seating system is shown with base 102 with a seating surface 104 and a back support 106 (i.e. backrest and/or cushion) is shown in schematic (simplified) form according to an exemplary embodiment. The position and relationship of back support 106 (i.e. backrest and/or cushion) and base 102 with seating surface 104 is shown with the support or backrest in the upright position and the forward position, respectively. Backrest 106 has a generally frustum-shaped form (shown in profile in FIGS. 10A and 10B) (see also FIGS. 1B and 2). According to any exemplary embodiment, the backrest (regardless of its shape or form) presents an effective height and an effective width relative to the base (i.e. also relative to the seating surface/area of the base).

The relationship between the height and the width of the backrest (or support) and in reference to the base is indicated in a schematic (i.e. simplified) form. When backrest 106 is in the upright position (shown in FIGS. 10A and 1A), the height of the backrest is Hu and the width of the backrest is Wu; when backrest 106 is in the forward position (shown in FIGS. 10B and 1B), the height of the backrest is Hf and the width of the backrest is Wf. As shown, the height of the backrest in the upright position is greater than the height of the backrest in the forward position (i.e., Hu>Hf); the width of the backrest in the forward position is greater than the width of the backrest in the upright position (i.e., Wf>Wu). As shown in FIGS. 10A and 10B (as well as in FIGS. 1A-1E and 2), when the backrest is in the forward position, the backrest occupies a greater portion of the seating area of the base than when the backrest is in the upright position.

As indicated in FIGS. 1A-1E, 2, 3A-3E, 7 and 10A-10B, according to various exemplary embodiments, the backrest is moveable to an upright position and to a forward position by a translational and rotational movement (e.g. backrest 106 and backrest 106*a* in FIGS. 1A and 1B). As indicated schematically in FIGS. 3A-3C and 10A and 10B, the backrest is "flipped" (rather than folded down) when repositioned from the upright position to the forward position so that the respective surfaces or exposed areas of the backrest are reoriented. According to alternative embodiments, the seating system can be configured to provide for movement of the support of the backrest between the upright position and the forward position by any of a wide variety of suitable arrangements or methods. According to any preferred embodiment, the backrest is configured and designed to provide at least two stable and secure positions (i.e. upright position and forward position) that provide a suitable back support area for a person sitting on the seating surface.

According to any preferred embodiment, the articles of furniture (e.g. sofa, chair, etc.) will be configurable by positioning of one or more of the backrests (together or individually/separately as indicated in FIGS. 1A-1B and 1C-1D) to support a person or persons working in any of a wide variety of individual and collaborative activities and functions, including task activities and lounge activities, that persons may engage in or perform in a lounge area of a work environment. According to a particularly preferred embodiment, the articles of furniture will provide an attractive an inviting appearance and comfortable postural support for persons in the work environment.

The articles of furniture may be provided in any of a wide variety of configurations and ornamental appearances, including conventional arrangements or collections that may be positioned on the floor in an office area or lounge area or otherwise in a work environment. The articles of furniture (including the seating system) may use any suitable materials of construction for the various structures and components, for example, metal, wood, plastics and composite materials, combinations of materials, as well as coverings such as fabric or plastic or other types of covering (i.e. having a suitable durability and ornamental appearance).

According to any exemplary embodiment, the back support or backrest may be provided in any of a wide variety of forms, profiles and shapes such as trapezoidal, rectilinear, prismatic, frustum-shaped, elliptical, rounded, curved, etc. and may provide support areas or support surfaces in multiple positions and quantity (e.g. three, four, five, six or more/less areas or surfaces, whether discrete or continuous in form). The support areas or support surfaces presented by the backrest may be determined by the shape of the padding or cushion comprising the backrest.

The construction and arrangement of the elements of the present inventions as described in this application and as shown in the figures is illustrative only. Although certain exemplary embodiments of the present inventions have been described in detail in the present application, those skilled in the art who review the application will readily appreciate that many modifications are possible without materially departing from the subject matter, novel teachings and advantages of the present inventions. Accordingly, all such modifications are intended to be included within the scope of the present inventions. Other substitutions, modifications, changes and omissions may be made in the design, materials of construction, components and elements, arrangement and configuration, manner of operation and use, connection or coupling of components and elements (e.g. whether coupling is direct or indirect (i.e. using intermediate parts or components)), etc. of the preferred and other exemplary embodiments without departing from the spirit of the present inventions.

The system and method of the present inventions can incorporate and comprise known components and technology or may incorporate and comprise any other applicable technology (present or future) providing the capability to perform the functions and processes/operations indicated in the FIGURES. All such technology is considered to be within the scope of the present inventions.

We claim:

1. An article of furniture comprising:

a base providing a seating area and having a first edge and a second edge; a support coupled to the base near the first edge and a distance from the second edge; and a linkage coupling the support to the base so that the support can be presented in a generally upright position and in a generally forward position relative to the base;

wherein the distance from the second edge of the base to the support in the upright position is greater than the distance from the second edge of the base to the support in the forward position, and the support provides a surface that is a top surface when the support is in the upright position and is a rear surface positioned adjacent to the first edge of the base when the support is in the forward position; and wherein the support remains between the first edge and the second edge of the base in both the upright and forward positions.

2. The article of furniture of claim 1, wherein the linkage comprises a first hinge set coupled to the support and a second hinge set coupled to the base.

3. The article of furniture of claim 2, wherein the first hinge set comprises at least one hinge and the second hinge set comprises at least one hinge.

4. The article of furniture of claim 2, wherein the linkage comprises a hinge assembly; and wherein the hinge assembly comprises a base plate coupled to the first hinge set and to the second hinge set.

5. The article of furniture of claim 4, wherein the first hinge set is positioned on one side of the base plate and the second hinge set is positioned on an opposite side of the plate.

6. The article of furniture of claim 4, wherein the first hinge set comprises a plurality of hinges positioned on one side of the base plate and the second hinge set comprises a plurality of hinges positions positioned on an opposite side of the plate.

7. The article of furniture of claim 2, wherein the first hinge set is coupled to the support at a position intermediate one side of the support.

8. The article of furniture of claim 1, wherein the article of furniture comprises a plurality of supports and a plurality of linkages allowing at least one support of the plurality of supports to move independently of at least a second support of the plurality of supports between the generally upright and forward positions relative to the base.

9. The article of furniture of claim 8, wherein at least one panel wall is positioned behind at least one of the plurality of supports.

10. The article of furniture of claim 1, wherein the support is a unitary support.

11. The article of furniture of claim 10, wherein the unitary support substantially retains its shape in both the generally upright and forward positions.

12. An article of furniture comprising:

a base providing a seating area and having a back edge and a front edge; a support coupled to the base near the back edge and a distance from the front edge; and a linkage coupling the support to the base so that the support can be presented in a generally upright position and in a generally forward position relative to the base, the linkage including a plate; and wherein the plate is positioned behind the support when the support is in one of the generally upright or forward positions and the plate is positioned below the support when the support is in the other of the generally upright or forward positions.

13. The article of furniture of claim 12, wherein the plate is positioned behind the support when presented in the generally upright position and the plate is positioned below the support when presented in the generally forward position relative to the base.

14. The article of furniture of claim 12, wherein the distance from the front edge of the base to the support in the upright position is greater than the distance from the front edge of the base to the support in the forward position, and wherein the support provides a surface that is a top surface when the support is in the upright position and is a rear surface when the support is in the forward position.

15. The article of furniture of claim 12, wherein the plate is substantially rigid.

16. The article of furniture of claim 12, wherein the linkage comprises first and second hinges and wherein the first hinge is attached to a first side of the plate and the second hinge is attached to a second side of the plate.

17. The article of furniture of claim 16, wherein the first hinge is coupled to the support.

18. The article of furniture of claim 16, wherein the first hinge is coupled to the support at a position intermediate one side of the support.

19. The article of furniture of claim 16, wherein the second hinge is coupled to the base.

20. The article of furniture of claim 19, wherein at least one post is positioned between the second hinge and the base.

21. The article of furniture of claim 12, wherein the article of furniture includes a plurality of supports and a plurality of linkages allowing at least one support of the plurality of supports to move independently of at least a second support of the plurality of supports between the generally upright and forward positions relative to the base.

22. The article of furniture of claim 21, wherein at least one panel wall is positioned behind at least one of the supports.

* * * * *